US008205338B2

(12) United States Patent
Xie

(10) Patent No.: US 8,205,338 B2
(45) Date of Patent: Jun. 26, 2012

(54) METHOD OF MAKING A MULTI-LOBED NOZZLE

(75) Inventor: Yonglin Xie, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 94 days.

(21) Appl. No.: 12/544,396

(22) Filed: Aug. 20, 2009

(65) Prior Publication Data

US 2011/0041335 A1 Feb. 24, 2011

(51) Int. Cl.
*B21D 53/76* (2006.01)

(52) U.S. Cl. ..... 29/890.1; 29/25.35; 347/47

(58) Field of Classification Search ..... 29/890.1, 29/889.22, 25.35, 852, 846–547; 216/27, 216/33; 347/51, 61–62, 65
See application file for complete search history.

(56) References Cited

U.S. PATENT DOCUMENTS 4,789,425 A 12/1988 Drake et al.
5,305,018 A 4/1994 Schantz et al.
6,123,863 A * 9/2000 Shimomura et al. ..... 216/27
6,203,145 B1 3/2001 Jeanmaire et al.
6,254,219 B1 7/2001 Agarwal et al.
6,449,831 B1 * 9/2002 Komplin et al. ..... 29/611
6,520,626 B1 2/2003 Murakami
6,527,369 B1 3/2003 Weber et al.
6,757,973 B2 * 7/2004 Park ..... 29/890.1
6,871,400 B2 * 3/2005 Kitahara ..... 29/890.1
6,918,658 B2 * 7/2005 Kitahara ..... 347/68
7,516,549 B2 * 4/2009 Asuke ..... 29/890.1
2003/0184616 A1 * 10/2003 Yang et al. ..... 347/47
2006/0028511 A1 * 2/2006 Chwalek et al. ..... 347/65
2008/0136867 A1 6/2008 Lebens et al.

* cited by examiner

*Primary Examiner* — Minh Trinh
(74) *Attorney, Agent, or Firm* — Eugene I. Shkurko

(57) ABSTRACT

A method of forming a multi-lobed nozzle in a nozzle plate. A mask may be used to pattern photoresist on the nozzle plate or for patterning a polymer dry film, for example, which is then used for etching the plate to form multi-lobed nozzles. The formed nozzle plate is disposed over a substrate having a chamber for fluid formed therein and the chamber may include walls for supporting the nozzle plate. The fluid chamber includes a heater over the substrate for ejecting fluid through the nozzle via rapid heating of the fluid. Continuous supply of fluid is provided by forming a fluid supply channel in communication with the fluid chamber.

18 Claims, 21 Drawing Sheets

METHOD OF MAKING A MULTI-LOBED NOZZLE

CROSS REFERENCE TO RELATED APPLICATIONS

Reference is made to commonly assigned, co-pending U.S. patent applications: Ser. No. 12/544,331 by Yonglin Xie filed of even date herewith entitled "Drop Ejector Having Multi-Lobed Nozzle"; and Ser. No. 12/544,434 by Yonglin Xie filed of even date herewith entitled "Drop Ejection Method Through Multi-Lobed Nozzle"; the disclosures of which are incorporated herein by reference in their entireties.

FIELD OF THE INVENTION

This invention relates generally to the field of printing devices, and more particularly to the shape of a nozzle for drop ejector, for example for an inkjet printing device.

BACKGROUND OF THE INVENTION

Many types of printing systems include one or more printheads that have arrays of dot forming elements that are controlled to make marks of particular sizes, colors, or densities in particular locations on the recording medium in order to print the desired image. In some types of printing systems the array(s) of dot forming elements extends across the width of the page, and the image can be printed one line at a time, as the recording medium is moved relative to the printhead. Alternatively, in a carriage printing system (whether for desktop printers, large area plotters, etc.) the printhead or printheads are mounted on a carriage that is moved past the recording medium in a carriage scan direction as the dot forming elements are actuated to make a swath of dots. At the end of the swath, the carriage is stopped, printing is temporarily halted and the recording medium is advanced. Then another swath is printed, so that the image is formed swath by swath.

In an inkjet printer, the dot forming elements are also called drop ejectors. A drop ejector includes a nozzle and a drop forming mechanism (such as a resistive heater for thermal inkjet, or a piezoelectric device for piezoelectric inkjet) in order to generate pressure within an ink-filled chamber and eject ink from the nozzle. In page-width inkjet printers as well as in carriage inkjet printers, the printhead and the recording medium are moved relative to one another as drops are ejected in order to form the image. When drops are ejected from the nozzle toward the recording medium, a major portion of the ink is contained at the head of the drop, i.e. the leading portion of the drop. A lesser portion of the ink is contained in the tail of the drop, which initially takes the form of a narrower column of ink trailing the head of the drop. As the drop continues to fly toward the recording medium, the head typically moves at higher velocity and breaks off from the tail to form a main drop. The tail typically breaks up to form one or more smaller satellite drops that hit the recording medium after the main drop, because they are slower than the main drop. Because the recording medium is being moved with respect to the printhead, the slower satellite drops land at a different position than the main drop. In addition, there can be an angular difference in the trajectories of the main drop and the satellite drops, leading to further displacement, which can be additive to or subtractive from the velocity-dependent separation, depending on relative motion direction of printhead and recording medium. In a bi-directional print mode in a carriage printer, the satellite drops can land on one side of the main drop during a right-to-left printing pass, and on the other side of the main drop during a left-to-right printing pass. Thus satellite spots can cause printing defects including broadened vertical line width, fuzzy vertical line edges, and apparent jaggedness between portions of a vertical line that are printed by successive swaths printed in different directions.

In the prior art attempts have been made to reduce print defects due to satellites by reducing print speed, changing ink formulation to modify properties such as surface tension, or refining pulse optimization. Other attempts have included using an asymmetric nozzle to steer satellite drops so that they tend to land closer to the main drop, when printing in a preferred direction. However, with such a nozzle geometry, satellite caused defects are compounded when printing in the opposite direction.

What is needed is an improved inkjet printing device that is capable of printing at full speed, is compatible with a wide range of inks and driving conditions. In addition, what is needed for carriage printers having bi-directional print modes is an inkjet printing device that reduces satellite printing defects for both left-to-right and right-to-left printing swaths.

SUMMARY OF THE INVENTION

A preferred embodiment of the present invention is a method of forming a multi-lobed nozzle in a nozzle plate. The multi-lobed nozzle can be formed in a variety of ways. A mask may be used to pattern photoresist on the nozzle plate which is then used for etching the plate to form multi-lobed nozzles. The formed nozzle plate, in another embodiment, can be disposed over a substrate having a chamber for fluid formed therein and the chamber may include walls for supporting the nozzle plate. The fluid chamber includes a heater over the substrate for ejecting fluid through the nozzle via rapid heating of the fluid. Continuous supply of fluid can be provided by forming a fluid supply channel in communication with the fluid chamber.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. Many changes and modifications may be made within the scope of the present invention without departing from the spirit thereof, and the invention includes all such modifications. The figures below are not intended to be drawn to any precise scale with respect to size, angular relationship, or relative position.

DETAILED DESCRIPTION OF THE INVENTION

Figure 1:
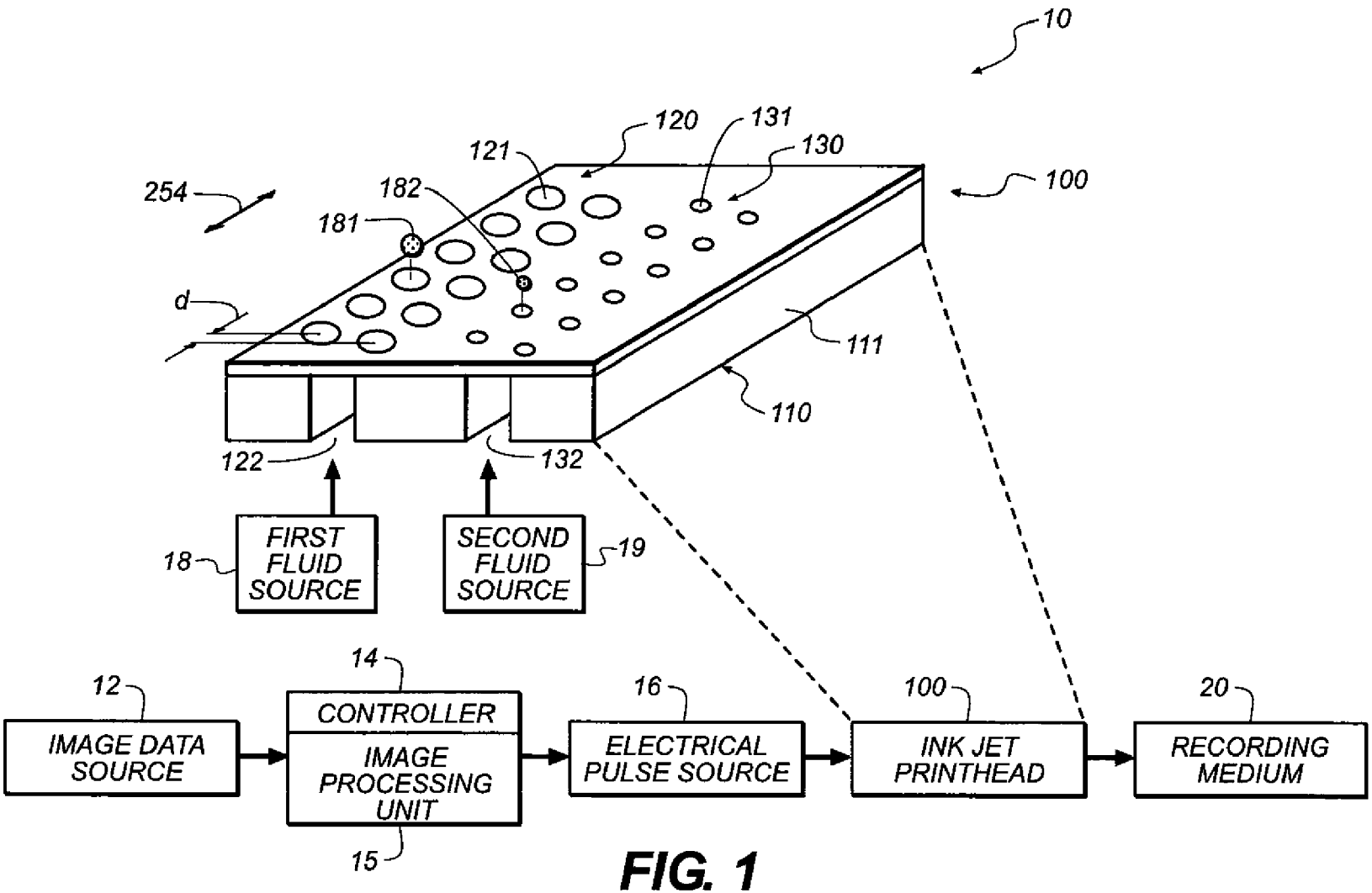
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, which is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays 120 and 130 in the printhead that are each disposed along an array direction 254.

Nozzles in the two nozzle arrays 120 and 130 are shown as circular in the generic example FIG. 1. Circular nozzles will serve as a comparative example for the multi-lobed shaped embodiments of the present invention described below.

In the example of FIG. 1, nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. $d=1/1200$ inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a mounting support member as discussed below relative to FIG. 3. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element or by electrostatic forces) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
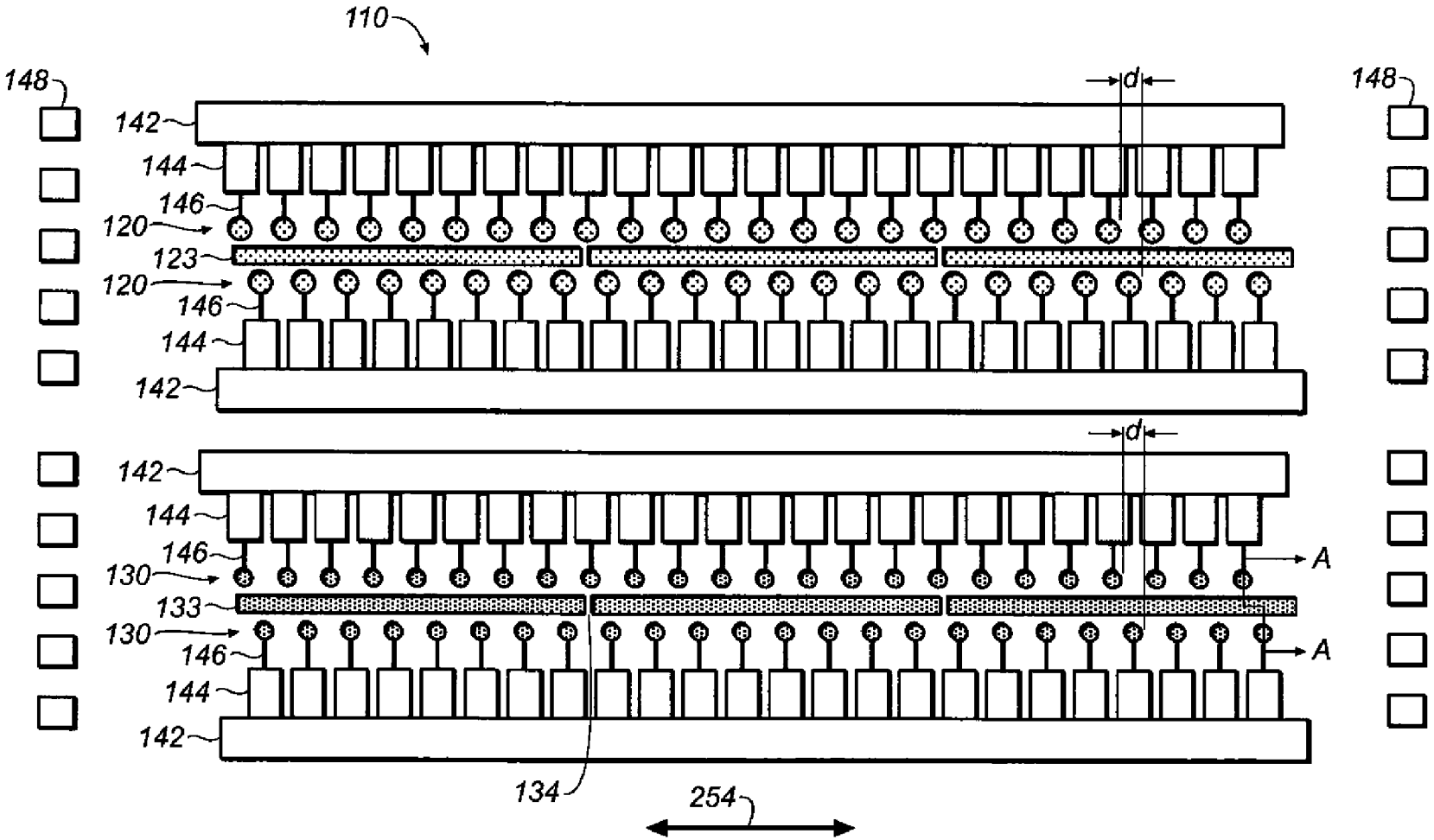
FIG. 2 is a schematic layout of a printhead die including two nozzle arrays plus associated electronics.

A printhead die 110 having array lengths of a half inch with nozzles at 1200 per inch will have about 600 nozzles per array. For printhead die 110 that have more than one hundred nozzles, logic electronics 142 and driver transistors 144 are typically integrated onto the printhead die 110 so that the number of interconnection pads 148 can be reduced, as illustrated in the schematic printhead die layout of FIG. 2. Rather than requiring an interconnection pad 148 for each nozzle in nozzle arrays 120 and 130 in order to power the associated drop forming mechanisms, a few inputs, such as serial data, clock, ejector power, logic power, ground, and other control signals are connected to interconnection pads 148. Electrical input signals, plus power and ground are connected to the logic electronics and driver transistors by wiring (not shown) that is patterned on the printhead die 110. Electrical leads 146 bring power pulses from the driver transistors 144 to the drop forming mechanisms associated with the nozzles in nozzle arrays 120 and 130. Also shown in FIG. 2 are ink feed openings 123 and 133 that are part of ink delivery pathways 122 and 132 (with reference to FIG. 1) for nozzle arrays 120 and 130 respectively. For staggered arrays, a typical ink feed opening design is a slot that extends parallel to array direction 254 between the two rows of nozzles in a staggered array. For mechanical strength, rather than a continuous ink feed slot that extends the length of the nozzle array, there can be a series of ink feed slots with strengthening ribs 134 between adjacent slots, as illustrated in FIG. 2.

Figure 3:
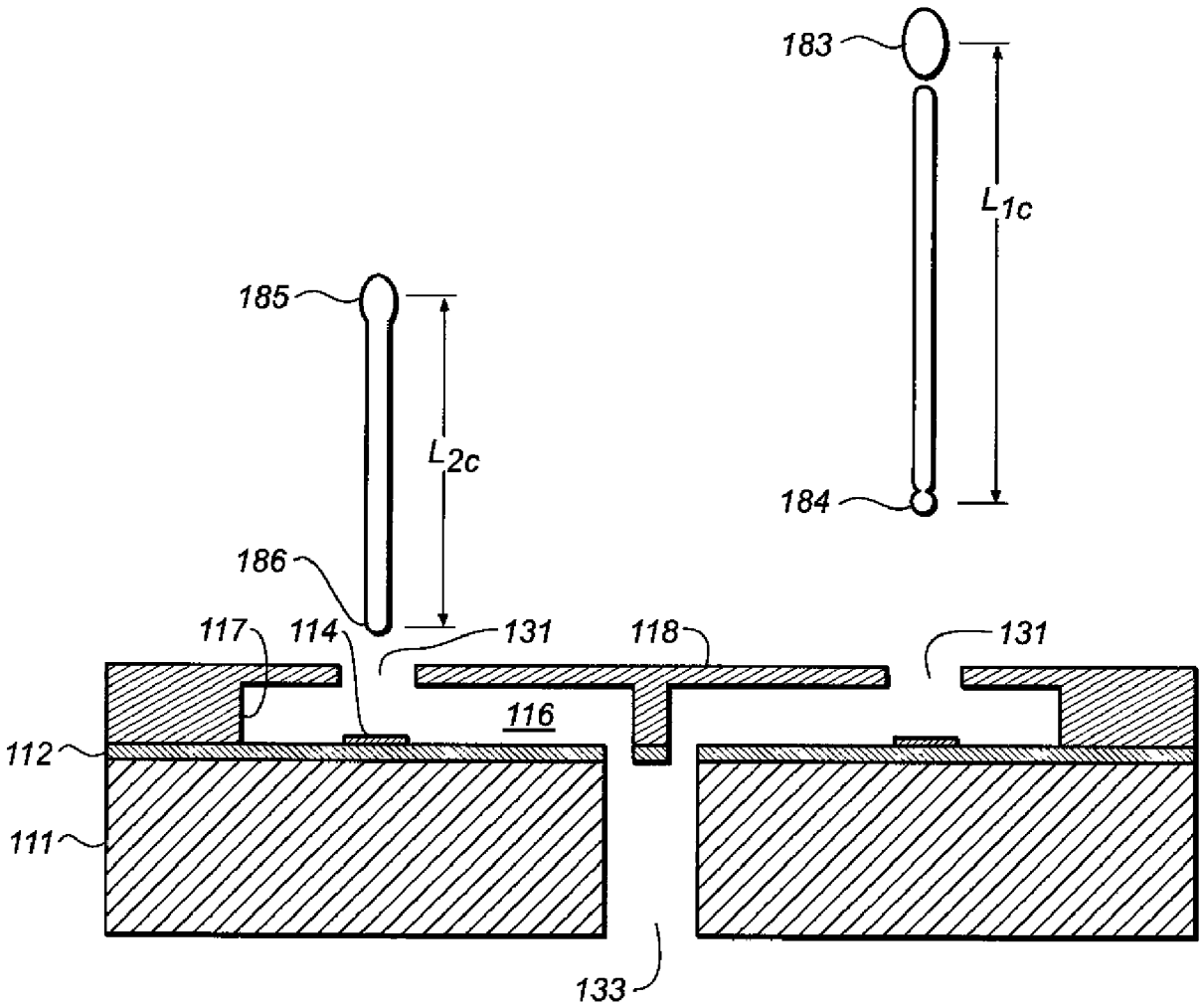
FIG. 3 is a cross sectional view of two drop ejectors together with ejected drops at two different times for circular nozzles.

FIG. 3 is a cross-sectional view of a portion of printhead die 110 along direction A-A seen in FIG. 2. Note that direction A-A jogs as it crosses ink feed slot 133, so that the cross section goes through nozzles 131 on each side of the staggered array of nozzles. Each nozzle 131 is opposite a resistive heater 114, which serves as the drop forming mechanism in this example. The heater 114 is located in an ink-filled chamber 116. The floor of the chamber 116 typically includes a plurality of thin film layers 112, including a thermal barrier layer below the heater 114. The nozzle 131 is formed in nozzle plate 118, which forms the roof of chamber 116. Chamber walls 117 support the nozzle plate 118 and separate it from the floor of the chamber 116.

Also shown in FIG. 3 is a schematic representation of drop ejection behavior for the comparative example of circular nozzles. Drops of ink are ejected when heater 114 is pulsed and heats rapidly to form a bubble which expands and pushes ink from chamber 116 through nozzle 131. The drop from the nozzle 131 at right was ejected earlier than the drop from the nozzle 131 at left. Drop shapes in FIG. 3 are similar to those seen about 20 microseconds after pulsing the heater 114 (for the drop at right) and about 10 microseconds after pulsing the heater 114 (for the drop at left). Note that the drop at right has a length $L_{1c}$ from head 183 to tail 184 that is somewhat longer than the length $L_{2c}$ from head 185 to tail 186 for the drop at the left. In other words, as the drop continues to travel, it elongates. This is because the velocity of the head of the drop is faster than that of the tail of the drop.

Figure 4:
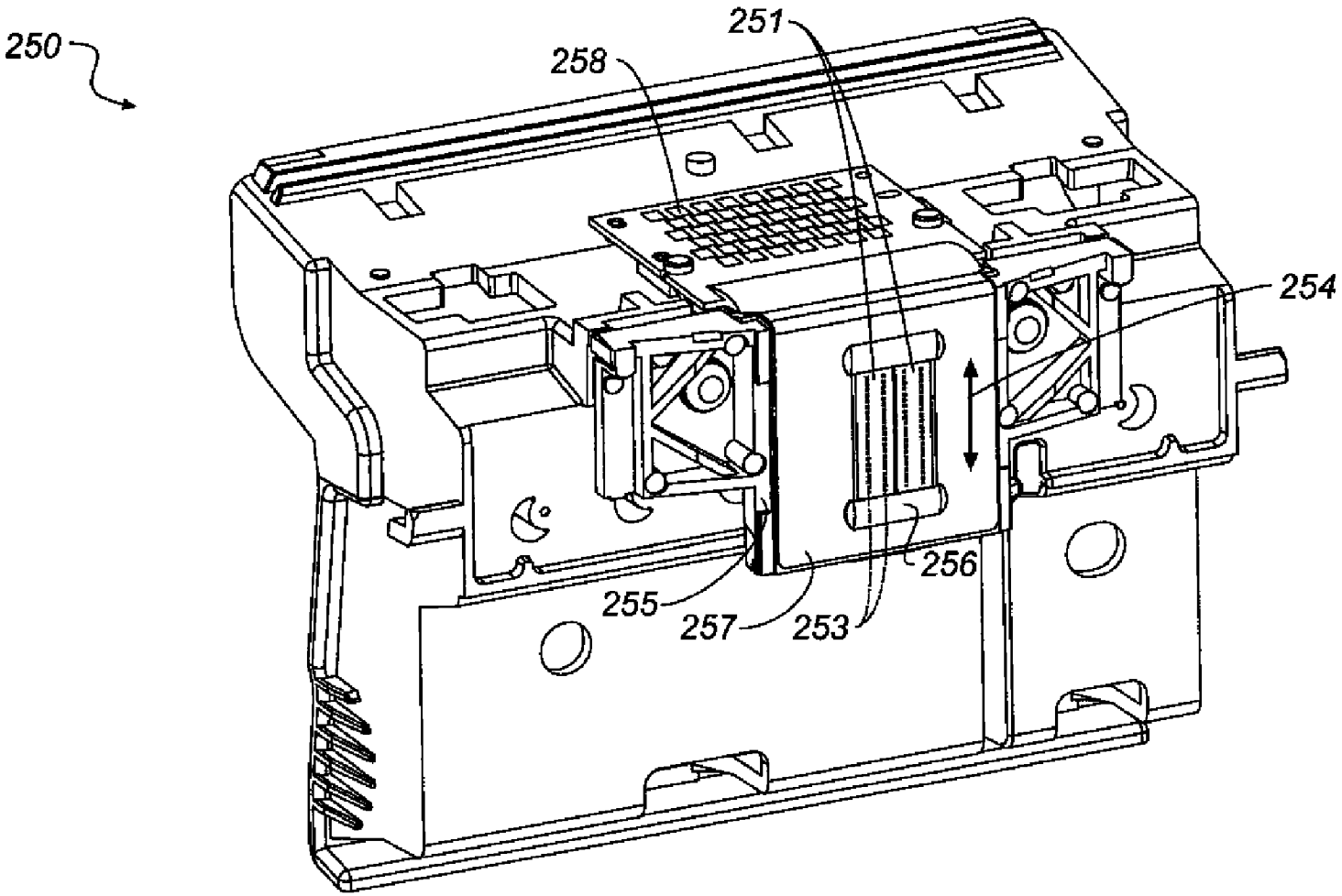
FIG. 4 is a perspective view of a portion of a printhead chassis.

FIG. 4 shows a perspective view of a portion of a printhead chassis 250. Printhead chassis 250 includes two printhead die 251 (similar to printhead die 110 of FIGS. 1 and 2) that are affixed to a common mounting support 255. Each printhead die 251 contains two nozzle arrays 253, so that printhead chassis 250 contains four nozzle arrays 253 altogether. The four nozzle arrays 253 in this example can each be connected to separate ink sources (not shown in FIG. 4), such as cyan, magenta, yellow, and black. Each of the four nozzle arrays 253 is disposed along nozzle array direction 254, and the length of each nozzle array along nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead chassis 250 across the recording medium 20. Following the printing of a swath, the recording medium 20 is advanced along a media advance direction that is substantially parallel to nozzle array direction 254.

Also shown in FIG. 4 is a flex circuit 257 to which the printhead die 251 are electrically interconnected, for example, by wire bonding or TAB bonding. The interconnections and interconnection pads 148 (with reference to FIG. 2) are covered by an encapsulant 256 to protect them. Flex circuit 257 bends around a portion of printhead chassis 250 and connects to connector board 258. When printhead chassis 250 is mounted into the carriage 200 (see FIG. 5), connector board 258 is electrically connected to a connector (not shown) on the carriage 200, so that electrical signals can be transmitted from there to the printhead die 251.

Figure 5:
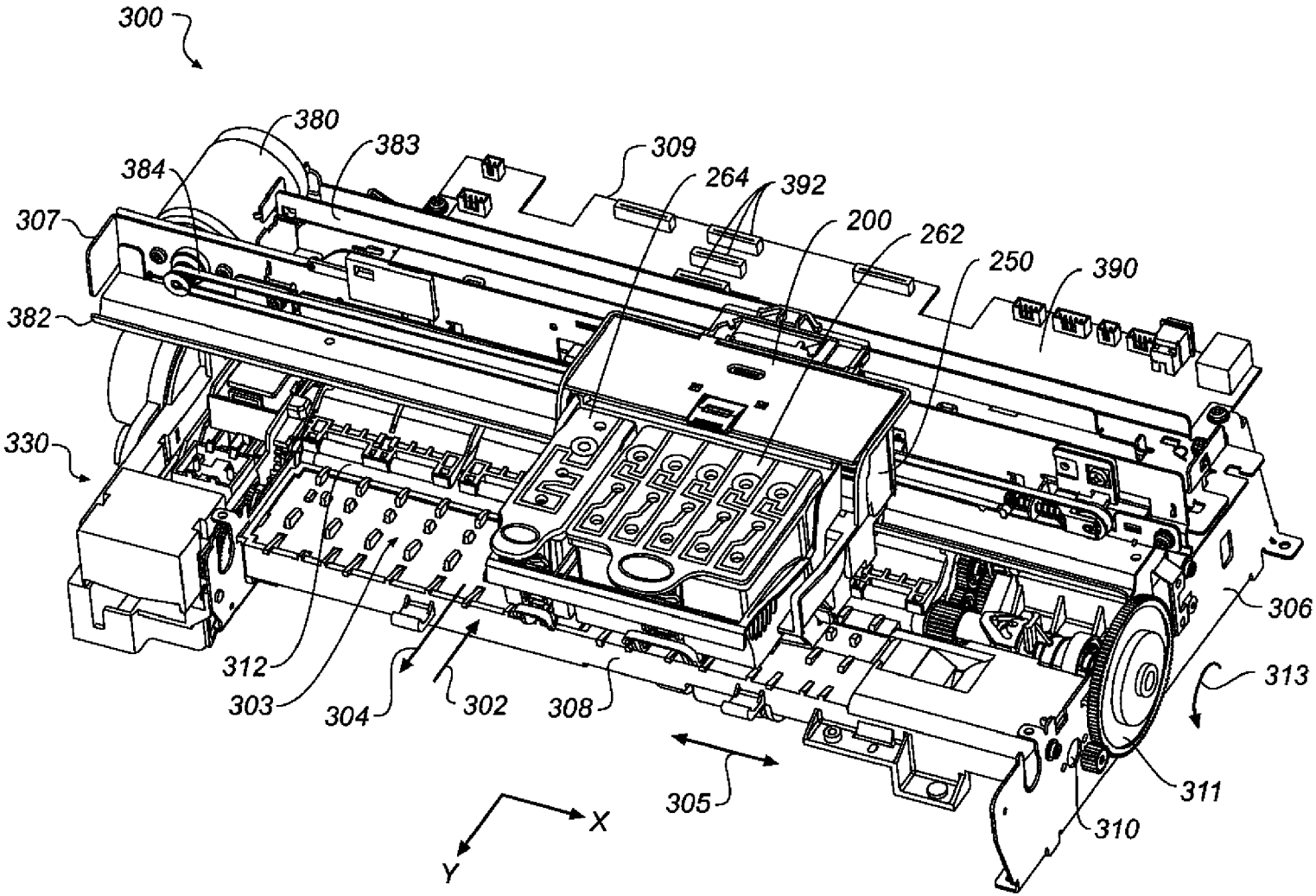
FIG. 5 is a perspective view of a portion of a carriage printer.

FIG. 5 shows a portion of a desktop carriage printer. Some of the parts of the printer have been hidden in the view shown in FIG. 5 so that other parts can be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 (not shown in FIG. 5) on printhead chassis 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead chassis 250 is mounted in carriage 200, and multi-chamber ink supply 262 and single-chamber ink supply 264 are mounted in the printhead chassis 250. The mounting orientation of printhead chassis 250 is rotated relative to the view in FIG. 4, so that the printhead die 251 are located at the bottom side of printhead chassis 250, the droplets of ink being ejected downward onto the recording medium in print region 303 in the view of FIG. 5. Multi-chamber ink supply 262, for example, contains three ink sources: cyan, magenta, and yellow ink; while single-chamber ink supply 264 contains the ink source for black. Paper or other recording medium (sometimes generically referred to as paper or media herein) is loaded along paper load entry direction 302 toward the front of printer chassis 308.

A variety of paper-advance rollers are used to advance the medium through the printer. The motor that powers the paper advance rollers is not shown in FIG. 5, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 5, is the maintenance station 330.

Toward the rear of the printer chassis 309, in this example, is located the electronics board 390, which includes cable connectors 392 for communicating via cables (not shown) to the printhead carriage 200 and from there to the printhead chassis 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Inventive aspects of the present invention relate to a nozzle design having a plurality of lobes that are narrower toward the central region of the nozzle and wider at a portion that is more distant from the central region of the nozzle. FIGS. 6A-6G show top views of a variety of multi-lobed nozzle configurations that are embodiments of the invention, but it can be appreciated that many other configurations are possible.

Figure 6A:
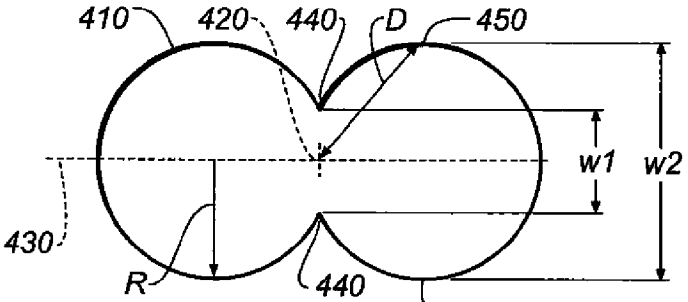
FIGS. 6A-6G are top views of embodiments of multi-lobed nozzles.

The embodiment shown in FIG. 6A is a nozzle opening made up of two intersecting circles having centers that are displaced from each other. The nonintersecting portion of each of the intersecting circles is a lobe 410. The nozzle opening also has a central region that is the intersection of the two circles. The central region includes the centroid 420 of the nozzle opening. The two lobes 410 extend in opposite directions away from centroid 420 along radial direction 430. Radial direction 430 is also an axis of symmetry of the nozzle. The nozzle of FIG. 6A is mirror symmetric about radial direction 430. The two lobes 410 are disposed symmetrically about the central region of the opening. The points of intersection of the two circles define a narrow portion 440 of the nozzle where the two lobes 410 each have a width w1. This narrow portion 440 is relatively near the centroid 420, and therefore is proximate the central region of the nozzle. The lobes 410 also each have a wider portion 450 where the width is w2 (i.e. w2>w1). The wider portion 450 is farther away from centroid 420 than the narrow portion 440 is. In particular, for two intersecting circles having the same radius R and an intersection width w1 (as in FIG. 6A) the distance D from centroid 420 to the wider portion 450 is $D=(2R^2-(0.5w1)^2)^{1/2}$. If the centers of the two intersecting circles are not coincident, then 0.5 w1 is less than R. Therefore, if the centers of the two intersecting circles are not coincident, D is greater than R, so that wider portion 450 is farther away from centroid 420 than the narrow portion 440 is (i.e. D>0.5w1)

Figure 6B:
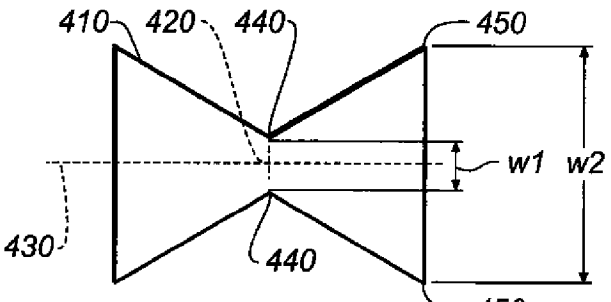

FIG. 6B is a nozzle opening embodiment made up of two intersecting triangles. The nonintersecting portion of each of the intersecting triangles is a lobe 410. Although a common definition of "lobe" is a "rounded projection", herein the term lobe will have the more general definition "any projection". Thus the term lobe is used to refer to two portions of FIG. 6B, as well as two portions of FIG. 6A. The nozzle opening also has a central region that is the intersection of the two triangles. The central region includes the centroid 420 of the nozzle opening. The two lobes 410 extend in opposite directions away from centroid 420 along radial direction 430. Radial direction 430 is also an axis of symmetry of the nozzle. The two lobes 410 are disposed symmetrically about the central region of the opening. The nozzle of FIG. 6B is mirror symmetric about radial direction 430. The points of intersection of the two triangles define a narrow portion 440 of the nozzle where the two lobes 410 each have a width w1. This narrow portion 440 is relatively near the centroid 420, and therefore is proximate the central region of the nozzle. The lobes 410 also each have a wider portion 450 where the width is w2 (i.e. w2>w1). The wider portion 450 is farther away from centroid 420 than the narrow portion 440 is. Because of its shape, the nozzle configuration of FIG. 6B is sometimes called a bowtie nozzle. Some embodiments of a bowtie nozzle have rounded corners (not shown).

Figure 6C:
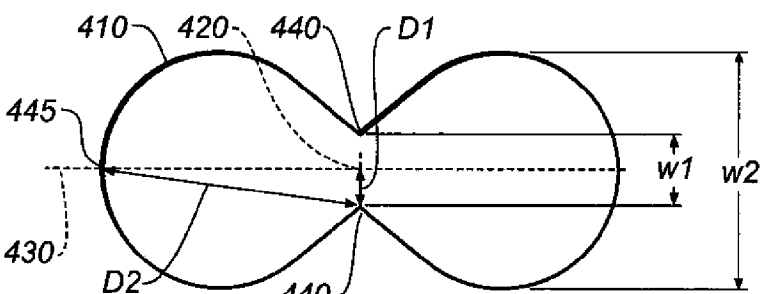

FIG. 6C is a nozzle configuration embodiment made up of two intersecting teardrop shaped portions. The general characteristics of two-lobed nozzles where the lobes have the same shape and area, as in FIGS. 6A and 6B also apply to the embodiment of FIG. 6C. Another property is shown with respect to FIG. 6C, which is also true of a number of other embodiments. In particular, the distance D1 from the centroid 420 to the nearest portion of nozzle wall at narrow portion 440 is less than the distance D2 from that nearest portion of wall at narrow portion 440 to the most distal edge 445 of the corresponding lobe 410.

Figure 6D:
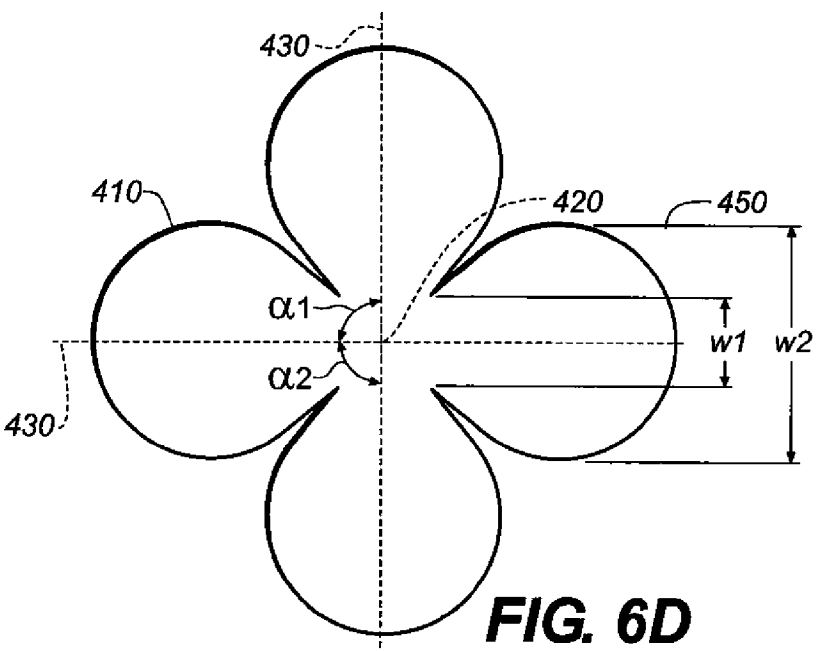

FIG. 6D is a nozzle opening embodiment made up of four intersecting teardrop shaped forms. The axes of symmetry 430 of the four lobes are at 90 degrees to each other (i.e. $\alpha 1=\alpha 2=90$ degrees). All four lobes in FIG. 6D have the same size and shape. Other properties of the two-lobed structures described with reference to FIGS. 6A to 6C also apply to the nozzle configuration of FIG. 6D.

Figure 6G:
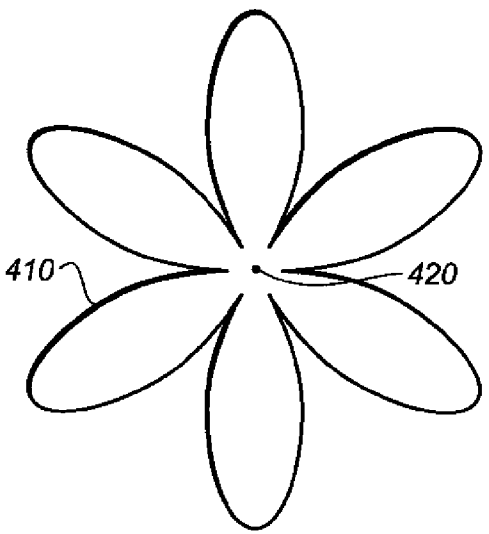
Figure 6F:
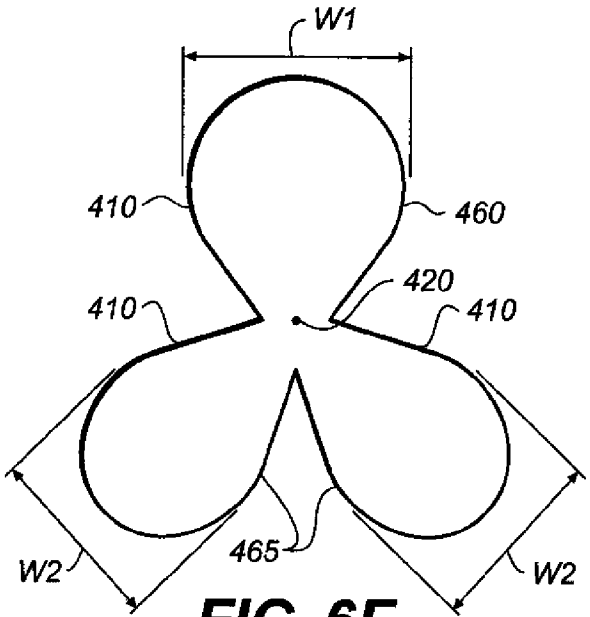
Figure 6E:
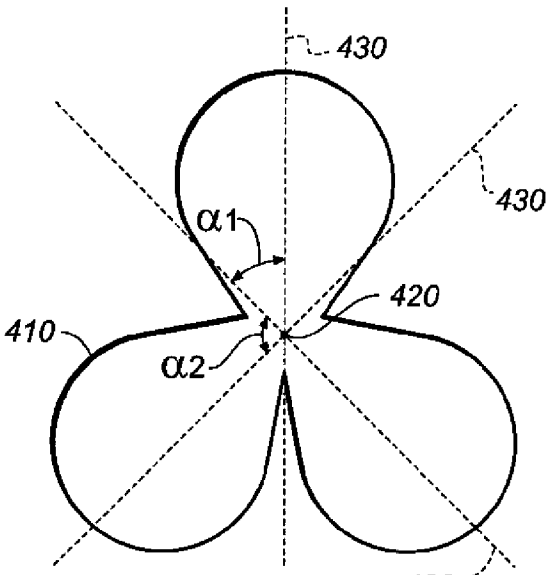

FIG. 6E is a nozzle opening embodiment made up of three intersecting teardrop shaped forms. In the embodiment of FIG. 6E, the axes of symmetry (radial direction 430) are not all at equal angles with respect to one another for adjacent lobes. In particular $\alpha 1=45$ degrees while $\alpha 2=90$ degrees. In other words, the plurality of lobes 410 in FIG. 6E have at least two different angles between two pairs of axes of symmetry of adjacent lobes.

FIG. 6F is a nozzle opening embodiment having three intersecting teardrop shaped forms as in FIG. 6E. However, in FIG. 6F, there is a wide lobe 460 and two narrow lobes 465. Wide lobe 460 has a larger width W1 and larger area than the width W2 and area respectively of a narrow lobe 465.

FIG. 6G is a nozzle opening embodiment having six lobes 410. Although in FIGS. 6A-6G, embodiments having less than or equal to six lobes have been shown, there also can be embodiments having more than six lobes.

The multi-lobed nozzle embodiments of the present invention have several performance advantages relative to circular, polygonal, or even star-shaped nozzles of the prior art. Some of these advantages are related to an increased ratio of perimeter to area of the nozzle opening of embodiments of the present invention. The nozzle area is related to the volume of the drop that is ejected. A large ratio of perimeter to area of nozzle opening allows increased nozzle wall interaction with the ink, both before and during drop ejection. Before drop ejection, a high perimeter to area ratio increases refill speed of the drop ejector by pulling ink into the nozzle. This enables higher frequency drop ejection, and higher speed printing as a result. In addition, the meniscus of the ink in the nozzle is pinned more stably by the large perimeter surface forces, thereby reducing the occurrence of nozzle plate flooding due to outward bulging of the meniscus. Such outward bulging of the meniscus can be caused by the momentum of ink flow to refill the nozzles, as well as by cross-talk due to firing neighboring nozzles. Furthermore, larger perimeter to area ratio of the nozzle increases the effectiveness of the surface tension force pulling the tail towards the head of the drop. This prevents the tail of the drop from breaking up into small satellite drops, or results in high satellite velocity relative to prior art nozzles, so that there is a small difference in the velocity of main drops and satellite drops. This reduces misting inside the printer caused by small satellite drops slowing down and stopping in flight by viscous air drag. This also leads to smaller displacement between satellite dots and main dots even during bidirectional printing. Typical inkjet inks have a surface tension of around 30 dynes/cm.

Figure 7A:
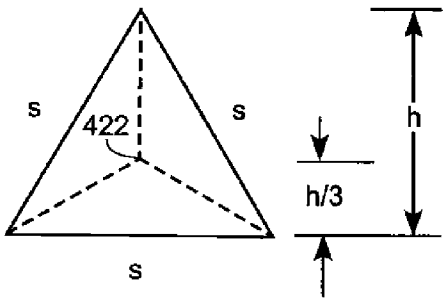
FIGS. 7A-7D show geometries of triangles and overlapping triangles.

FIGS. 7A to 7D illustrate the increased perimeter to area ratio of the two-lobed bowtie nozzle of FIG. 6B relative to triangular or six-pointed star nozzles of the prior art. FIG. 7A is an equilateral triangle having three equal sides of length s. Triangle centroid 422 is located at the intersection of the three medians (dotted lines in FIG. 7A) of the triangle. For an equilateral triangle, it can be shown that the centroid is located a distance h/3 from each of the sides, where $h=\sqrt{3}/2$ is the height of the triangle. The area of the equilateral triangle is $\sqrt{3}\ s^2/4$, while the perimeter is 3 s, so the ratio of the perimeter to area is $4\sqrt{3}/s=6.93/s$.

Figure 7B:
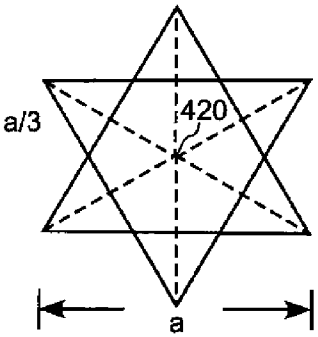

FIG. 7B is a six-pointed star made up of two mirrored equilateral triangles (solid lines) where the centroids of the two triangles (intersection of dotted line medians) are coincident at the centroid 420 of the star. Each of the mirrored triangles has a side of length a. The star points have sides of length a/3, and the hexagon at the center of the star also has sides of length a/3. The area of the star is $a^2/\sqrt{3}$, while the perimeter is 4a. The perimeter to area ratio has a similar expression as that of a single equilateral triangle ($4\sqrt{3}/a$). However, if the areas of the triangle of FIG. 7A and the star of FIG. 7B are constrained to be the same (to provide similar drop volumes), $\sqrt{3}\ s^2/4=a^2/\sqrt{3}$, so that $a=\sqrt{3}\ s/2$. Thus for similar nozzle areas, the perimeter to area ratio is increased for the star of FIG. 7B relative to the triangle of FIG. 7A by $2/\sqrt{3}$, i.e. a 15.4% increase.

Figure 7C:
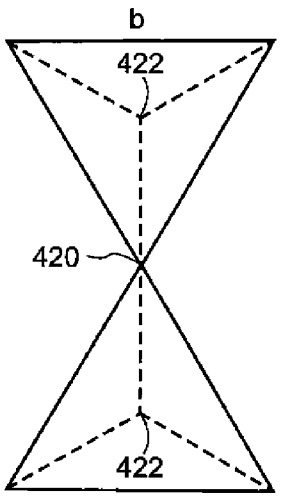

FIG. 7C is a bowtie made up of two mirrored equilateral triangles each having sides of length b and having coincident vertices at bowtie centroid 420. The centroids 422 of each individual triangle are displaced from one another by a distance $2b/\sqrt{3}$. The perimeter of the bowtie of FIG. 7C is 6b and the area is $\sqrt{3}\ b^2/2$. The perimeter to area ratio for the bowtie of FIG. 7C is $4\sqrt{3}/b$. If the area of the bowtie of FIG. 7C is set equal to the area of the star of FIG. 7B, then $\sqrt{3}\ b^2/2=a^2/\sqrt{3}$, so that $b=a\sqrt{(2/3)}$. Thus for similar nozzle areas, the perimeter to area ratio is increased for the bowtie of FIG. 7C relative to the star of FIG. 7B by $\sqrt{(3/2)}$, i.e. a 22.5% increase over the star.

Figure 7D:
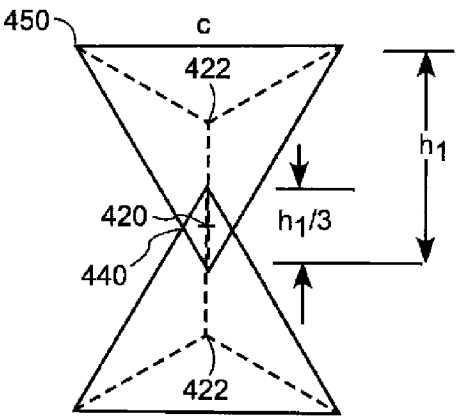

The bowtie of FIG. 7D is made up of two mirrored equilateral triangles each having sides of length c and having an overlap length of $h_1/3$, where $h_1=c\sqrt{3}/2$ is the height of the triangle. The shape of the overlapping bowtie of FIG. 7D is more nearly similar to the bowtie of FIG. 6B, although rotated by 90 degrees. Its perimeter is 16c/3 and its area is $35\sqrt{3}\ c^2/72$. If the area of the overlapping bowtie of FIG. 7D is set equal to the area of the six pointed star of FIG. 7B, the perimeter to area ratio of the overlapping bowtie is increased by 10.4% relative to the star.

Sometimes perimeter to area ratio is calculated with reference to a circle having the same area. A circle has a perimeter to area ratio of 2/R where R is the radius of the circle. A circle has the minimum ratio of perimeter to area of any plane geometrical shape. A single equilateral triangle (as in FIG. 7A) has a perimeter to area ratio of $2.57/R_{ef}$, where $R_{ef}$ is an effective radius determined by setting the area of the triangle equal to the area of the circle. Similarly a square has a perimeter to area ratio of 2.26/ $R_{ef}$ and a regular hexagon has a perimeter to area ratio of 2.10/ $R_{ef}$. As the number of sides of a polygon increases, its perimeter to area ratio approaches 2/ $R_{ef}$. The star of FIG. 7B has a perimeter to area ratio of 2.97/ $R_{ef}$. The nonoverlapping bowtie of FIG. 7C has a perimeter to area ratio of 3.64/ $R_{ef}$. The overlapping bowtie of FIG. 7D has a perimeter to area ratio of 3.28/ $R_{ef}$. Thus, although the star has a higher perimeter to area ratio than any of the regular polygons, the bowtie (even with some overlap as in FIG. 6B or 7D) has a higher perimeter to area ratio than a star.

Other performance advantages of embodiments of multi-lobed nozzles of the present invention relate to the small central region of the nozzle opening. The nozzle includes opposing sidewalls that converge toward each other in a central region of the nozzle for constricting a central region of the drop of liquid as the drop is ejected through the nozzle. The small opening in the central region causes the ink ligament to pinch off at the center of the nozzle, resulting in straighter jet trajectories for improved drop placement accuracy. In addition, the tail of the jet is shorter than for prior art nozzles, because the small opening at the central region causes the tail to pinch off sooner. This reduces ink volume available to form satellites, so that satellites are smaller and/or less numerous.

Figure 8:
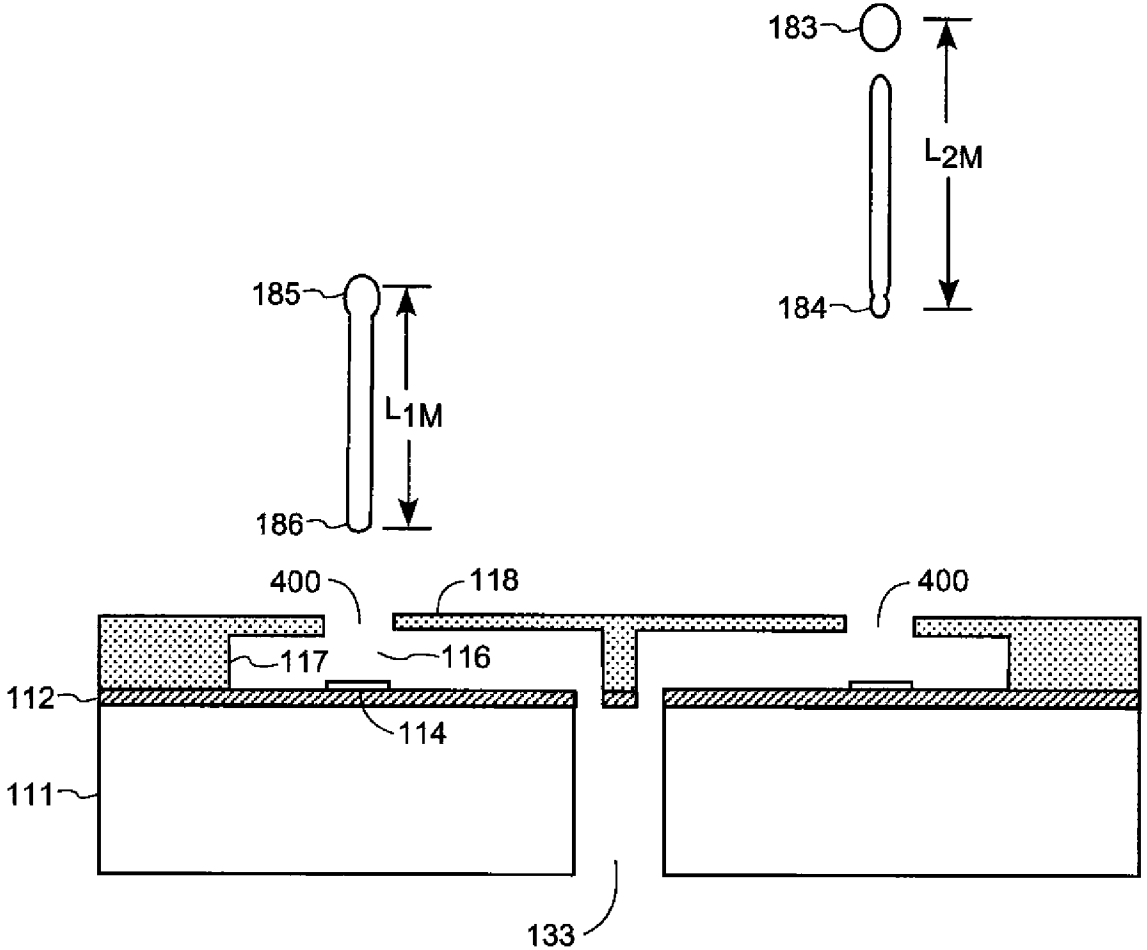
FIG. 8 is a cross-sectional view of two drop ejectors together with ejected drops at two different times for an embodiment of multi-lobed nozzles.

FIG. 8 shows a schematic representation of drop ejection behavior for the embodiment of a multi-lobed nozzle 400 having four lobes. Drops of ink are ejected when heater 114 is pulsed and heats rapidly to form a bubble which expands and pushes ink from chamber 116 through nozzle 400. The drop from the nozzle 400 at right was ejected earlier than the drop from the nozzle 400 at left. Drop shapes in FIG. 8 are similar to those seen about 20 microseconds after pulsing the heater 114 (for the drop at right) and about 10 microseconds after pulsing the heater 114 (for the drop at left). Note that the length $L_{2M}$ from head 185 to tail 186 for the drop at the left is about the same as the length $L_{2M}$ from head 183 to tail 184 for the drop at the right. In other words, as the drop continues to travel, it does not elongate, as does the drop ejected by circular nozzles shown in FIG. 3. This is because the velocity of the head of the drop is similar to that of the tail of the drop in the embodiment of FIG. 8.

Figure 9:
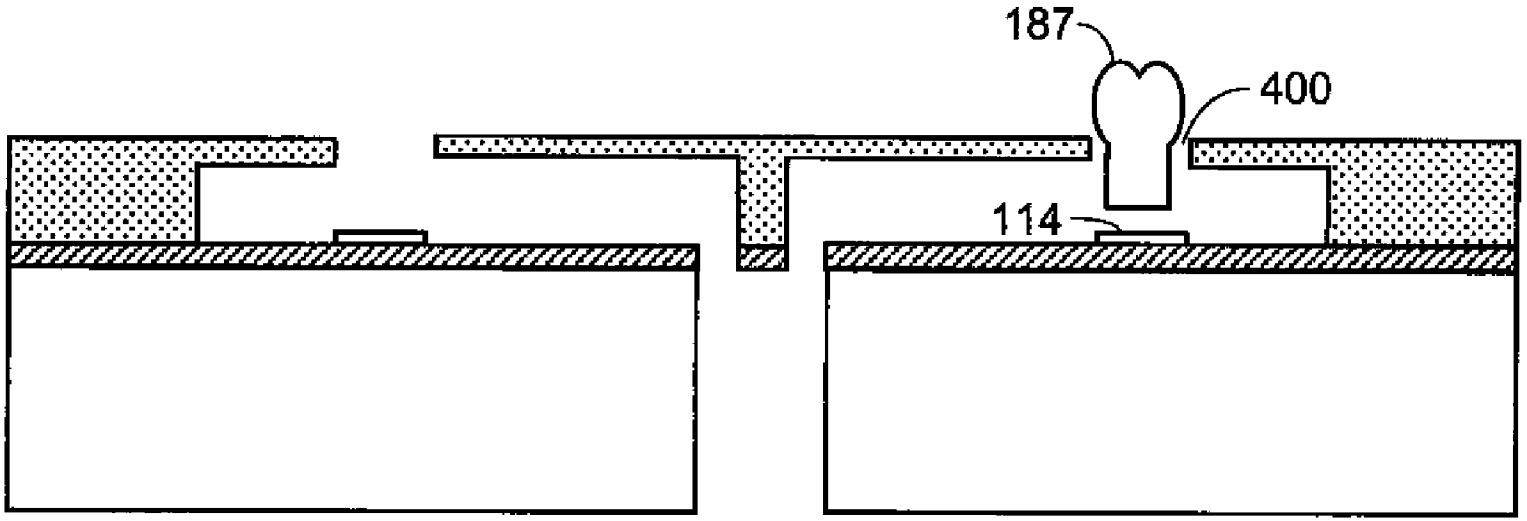
FIG. 9 is a cross-sectional view of two drop ejectors as ink is being extruded through a multi-lobed nozzle.

Furthermore, for a drop ejector having multi-lobed nozzle according to embodiments of the present invention, when the drop forming mechanism (such as heater 114) is actuated, the liquid ink (having a surface tension of around 30 dynes/cm for example) is ejected through the nozzle such that a quantity of liquid is forced through each of the plurality of lobes 410. The lobes of the present invention are more effective in applying surface forces to the ink than the points of a star of a star-shaped nozzle of the prior art. This is because for a star shaped nozzle, the liquid ink primarily goes through the large central region of the star. Not much liquid is forced through the points of the star so that the liquid near the points is substantially stagnant. For the present invention, ink at the narrow central region of the multi-lobed nozzle is not stagnant, but initially travels at a slower velocity due to higher viscous drag. As a result, as the extruded ink 187 is just being ejected from the multi-lobed nozzle 400, head and tail regions corresponding to each lobe can be observed, although they are still connected together, as schematically illustrated in FIG. 9. FIG. 9 represents an earlier time relative to FIG. 8, soon after actuating the drop forming mechanism, such as heater 114. Between FIG. 8 and FIG. 9, surface tension of the ink tends to collapse the heads from separate lobes into a single head, and also to collapse the tails from separate lobes into a single tail. By the time of FIG. 8, the drop head 183 and the drop tail 184 are traveling at substantially equal velocities before striking a receiving substrate (such as paper or other recording medium).

Figure 10:
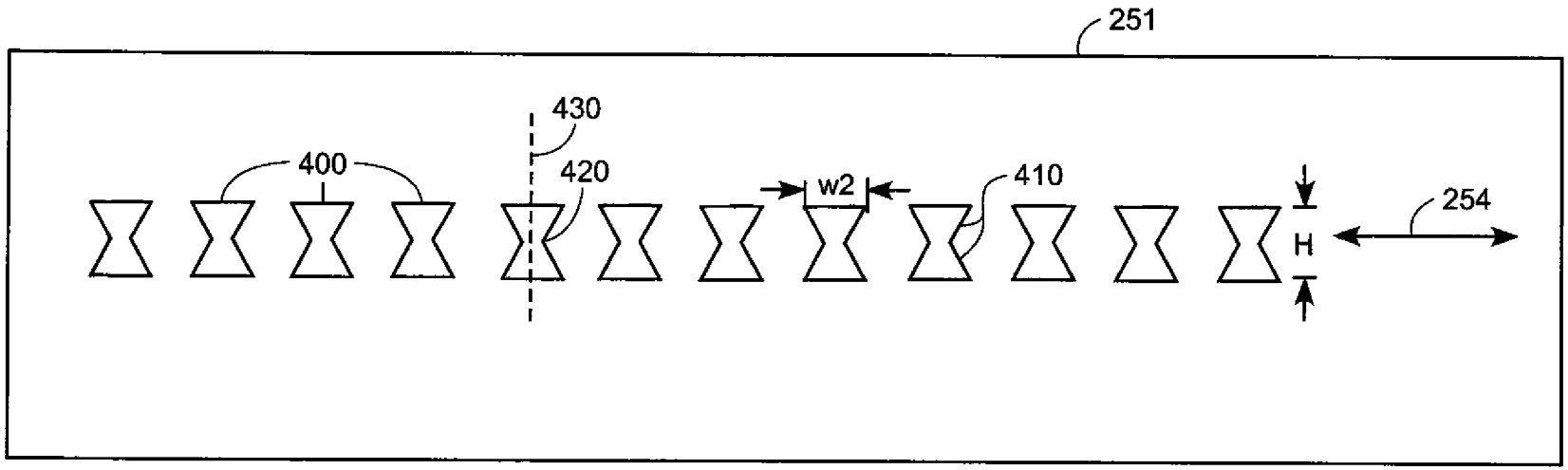
FIG. 10 is a printhead die having an array of multi-lobed nozzles.

FIG. 10 shows a printhead die 251 having an array of multi-lobed nozzles 400 disposed along array direction 254. In embodiments of the present invention, such a printhead die can be assembled into a printhead 250 such as the one shown in FIG. 4. In the particular example of FIG. 10, the nozzles have two lobes 410 and the nozzle configuration is the overlapping bowtie. For some nozzle configuration embodiments, such as the bowtie nozzle, the dimension H along the radial direction 430 from centroid 420 can be larger than the width w2 of wide portion 450 of lobe 410. In order to space the nozzles close together for a high resolution printhead, it can be advantageous to have the largest dimension of the nozzle perpendicular to array direction 254. For the example of FIG. 10 this is the same as the radial direction 430 along which a lobe 410 extends away from centroid 420 being perpendicular to array direction 254.

Figure 11A:
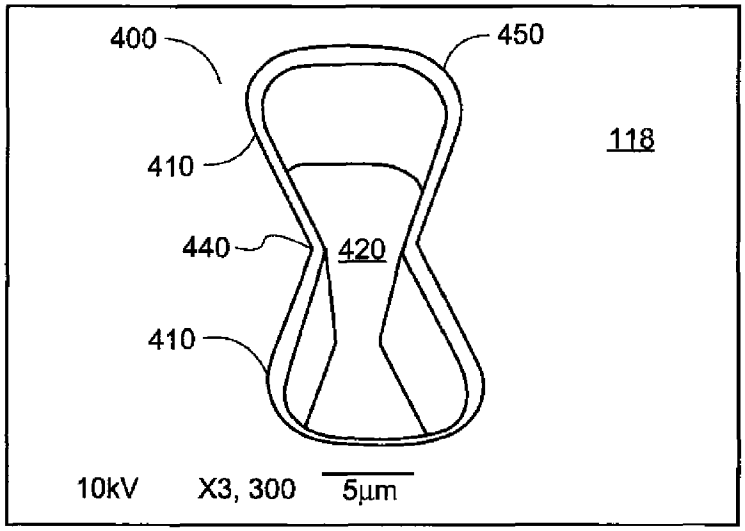
FIGS. 11A and 11B are perspective views respectively of two-lobed and four-lobed nozzles.
Figure 11B:
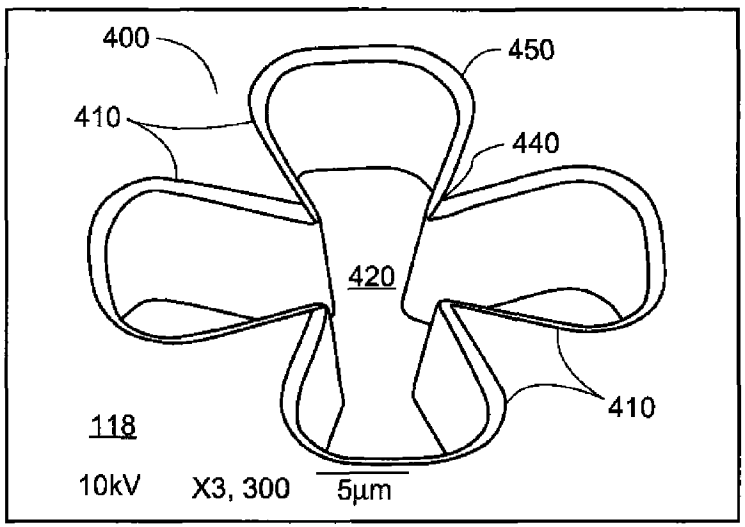
Figure 12A:
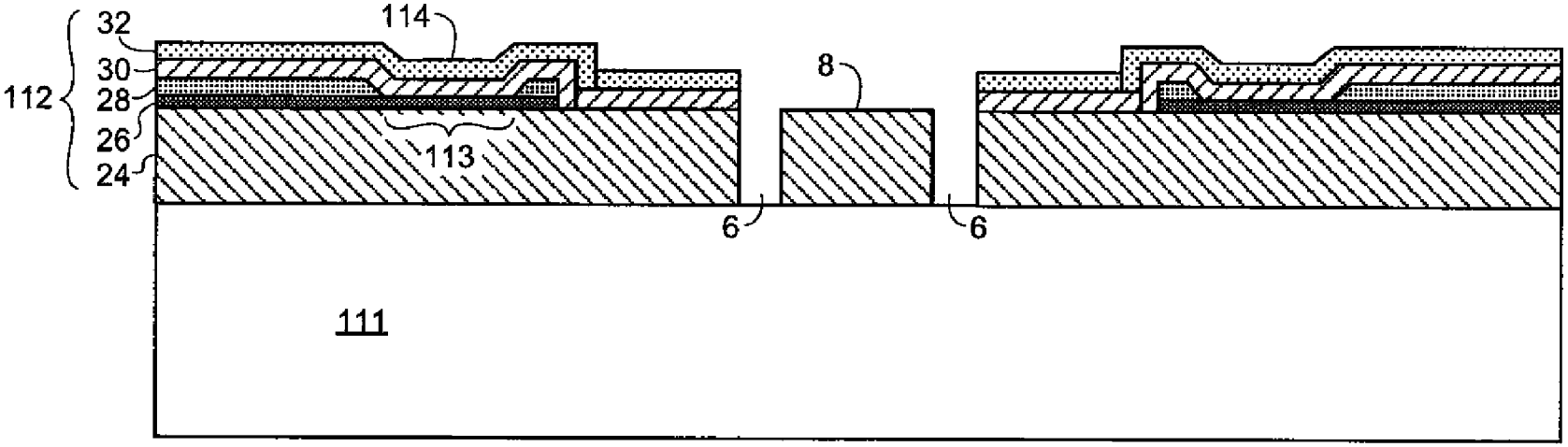
FIGS. 12A to 12I show a process for forming drop ejectors with multi-lobed nozzles.

A drop ejector having a multi-lobed nozzle can be fabricated in a variety of ways. FIGS. 11A and 11B show two-lobed and four-lobed nozzles, respectively, that were formed using the method described in published U.S. patent application Ser. No. 2008/0136867, which is incorporated herein by reference in its entirety. FIGS. 12A-12I show the process of forming the drop ejector structure having a multi-lobed nozzle as shown in FIGS. 11A and 11B. In FIG. 12A, the heater 114 and associated thin film layers 112 (including thermal barrier layer 24, for example, silicon dioxide, electrically resistive layer 26 (which forms resistive heating element 113), for example, tantalum silicon nitride, electrically conductive layer 28 (which carries electrical current to resistive heating element 113 and defines the length of resistive heating element 113), for example aluminum, insulating passivation layer 30, for example silicon nitride, and protection layer 32, for example, tantalum) have been formed on substrate 111 using commonly known processes. Two ink feed ports 6 (one for each row of nozzles) are etched through the thin film layers 112 down to the substrate 111. Between the two ink feed ports 6 is a chamber center support region 8.

Figure 12B:
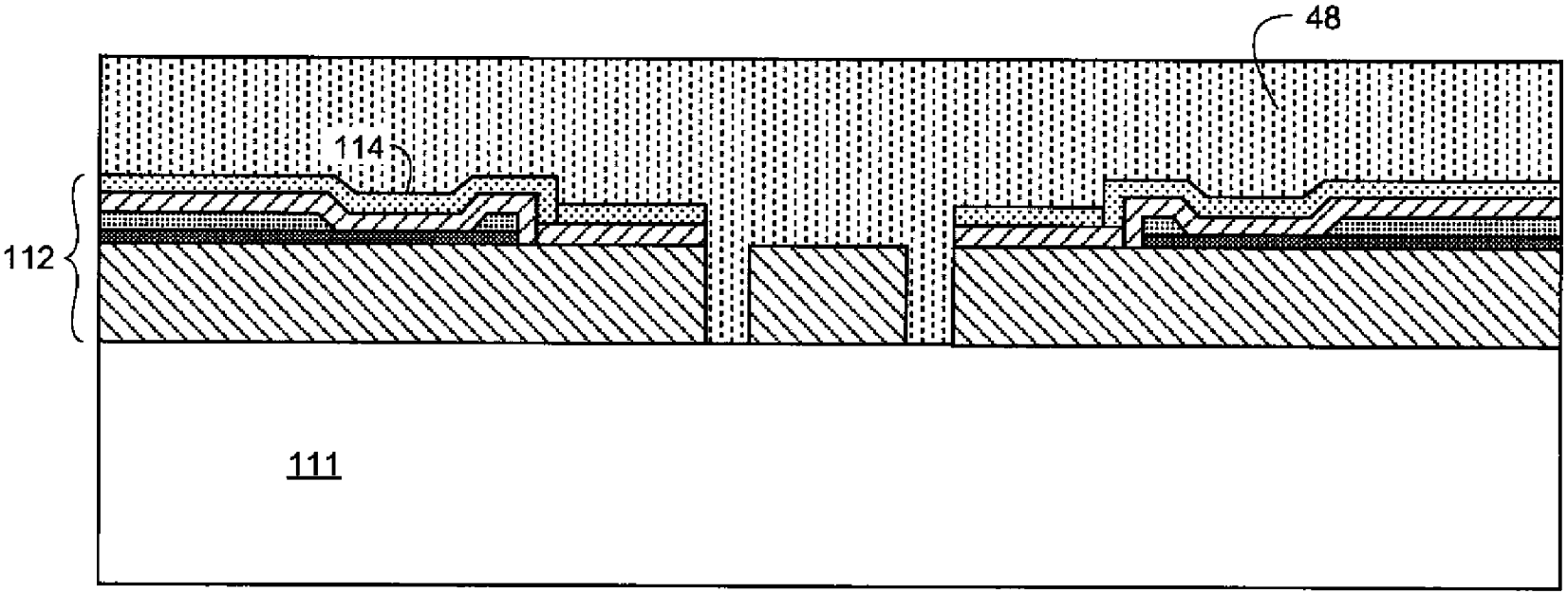
Figure 12C:
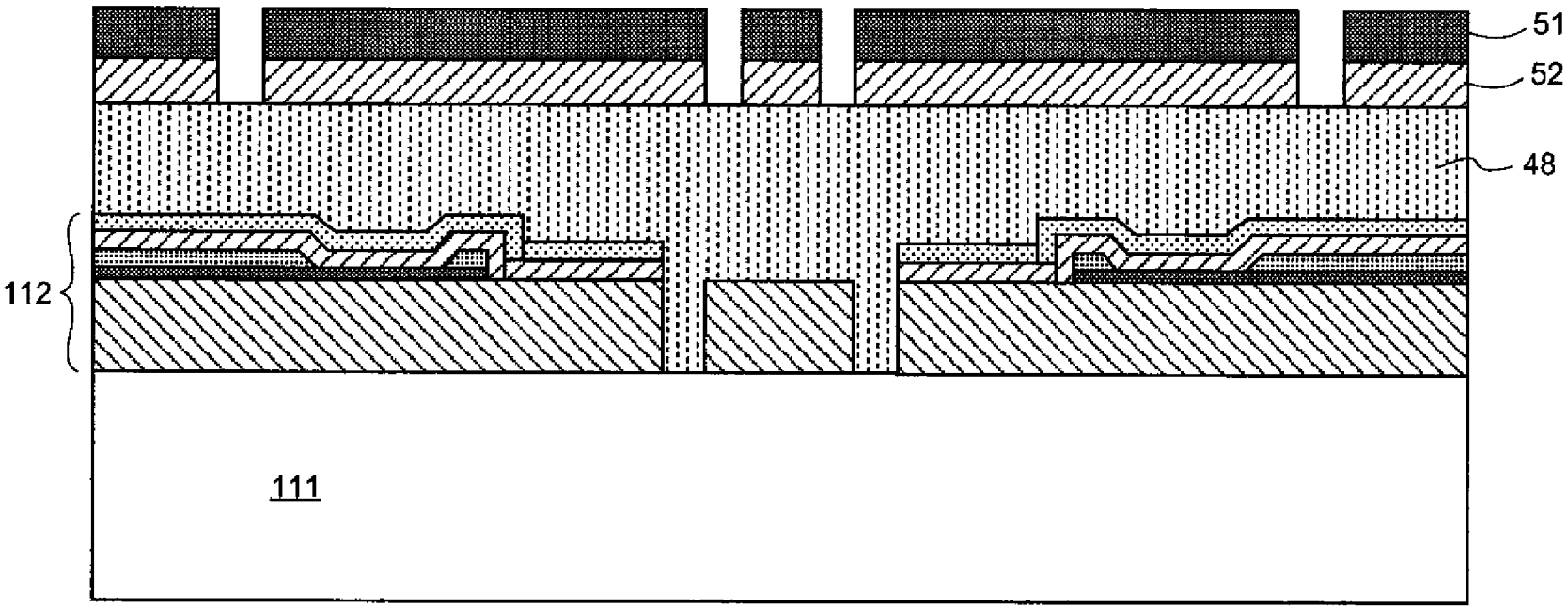
Figure 12D:
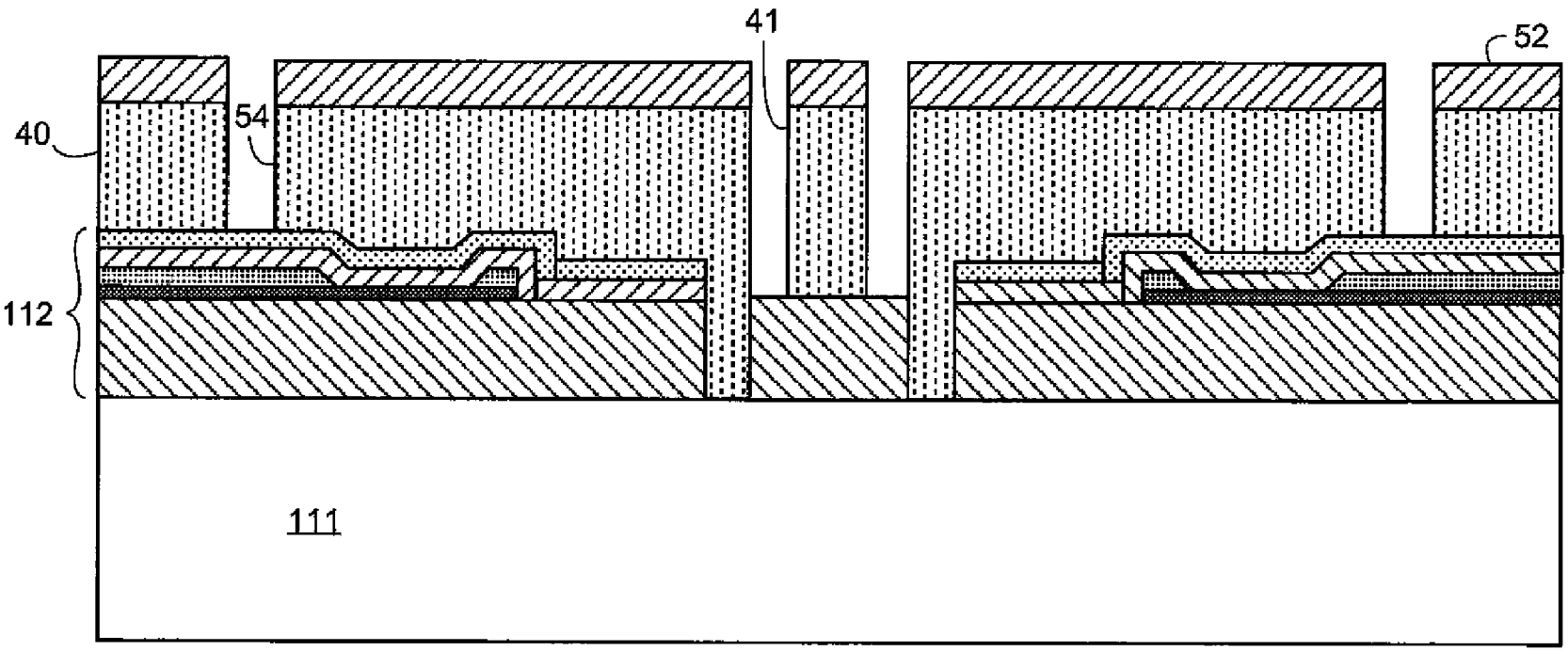

As shown in FIG. 12B, an organic material 48, such as polyimide, is deposited on the structure in a thickness that will define the height of the ink chamber. FIG. 12C shows a hard mask 52, such as silicon nitride, and a photoresist layer 51 deposited on the hard mask in order to pattern hard mask 51, as shown, by plasma etching. In FIG. 12D, the organic material 48 is patterned by oxygen plasma etching through hard mask 52 in order to form openings corresponding to subsequently formed features including chamber walls 117 and center support region walls 56 (see FIG. 12E). As part of this plasma etching process, photoresist layer 51 is removed. The organic material 48 is divided into three regions: a passivation region 40 that protects circuitry (not shown) formed on substrate 111 and provides support of the subsequently formed nozzle plate in regions away from the chamber; a center feed support 41 that provides structural support for the nozzle plate over the ink feed opening; and the sacrificial region 54 that defines the region where ink will be located in the printhead die, including the ink chamber.

Figure 12E:
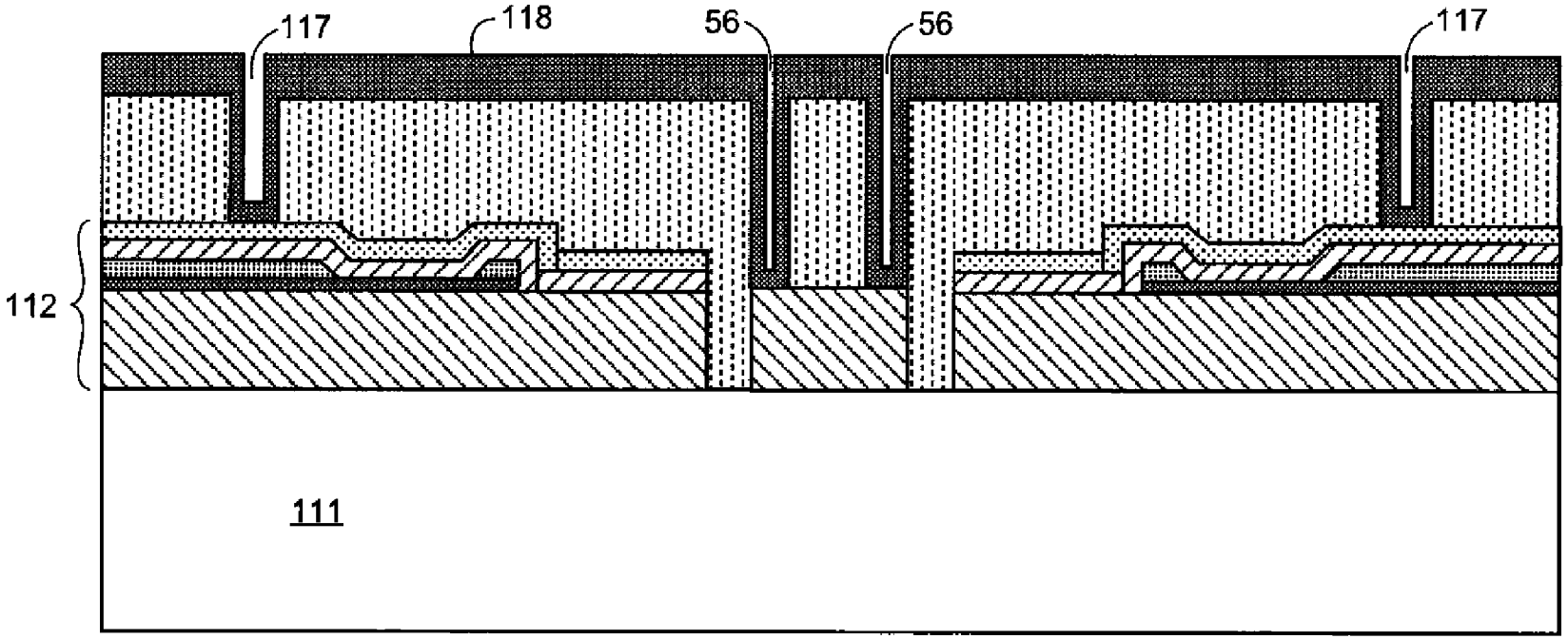

As shown in FIG. 12E, an inorganic material such as silicon oxide is then deposited, for example by plasma enhanced chemical vapor deposition. A portion of this inorganic material that is deposited within the openings becomes the chamber walls 117 and the center support region walls 56. Another portion of this inorganic material that is deposited over the organic material 48 becomes the nozzle plate 118.

Figure 12F:
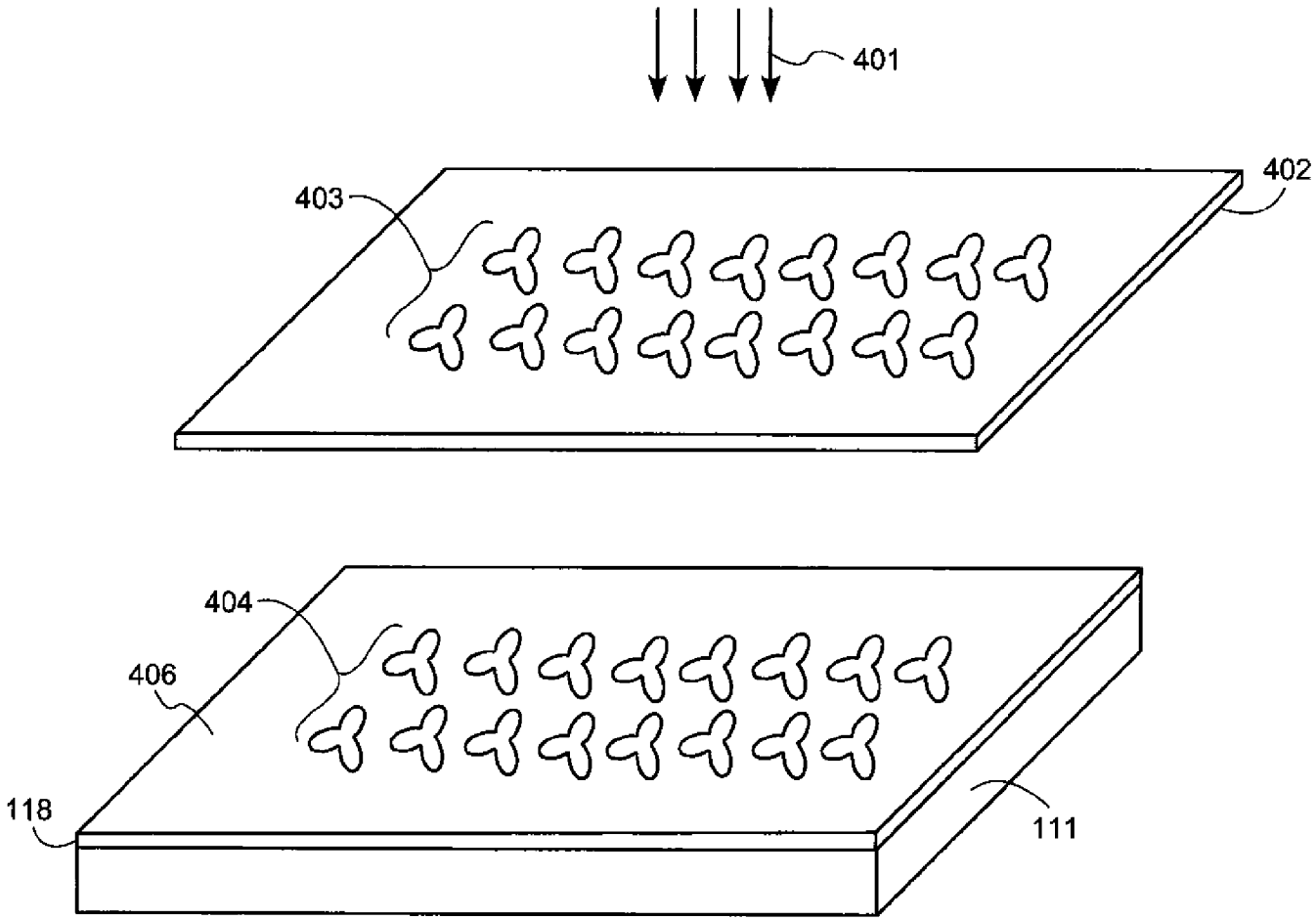
Figure 12G:
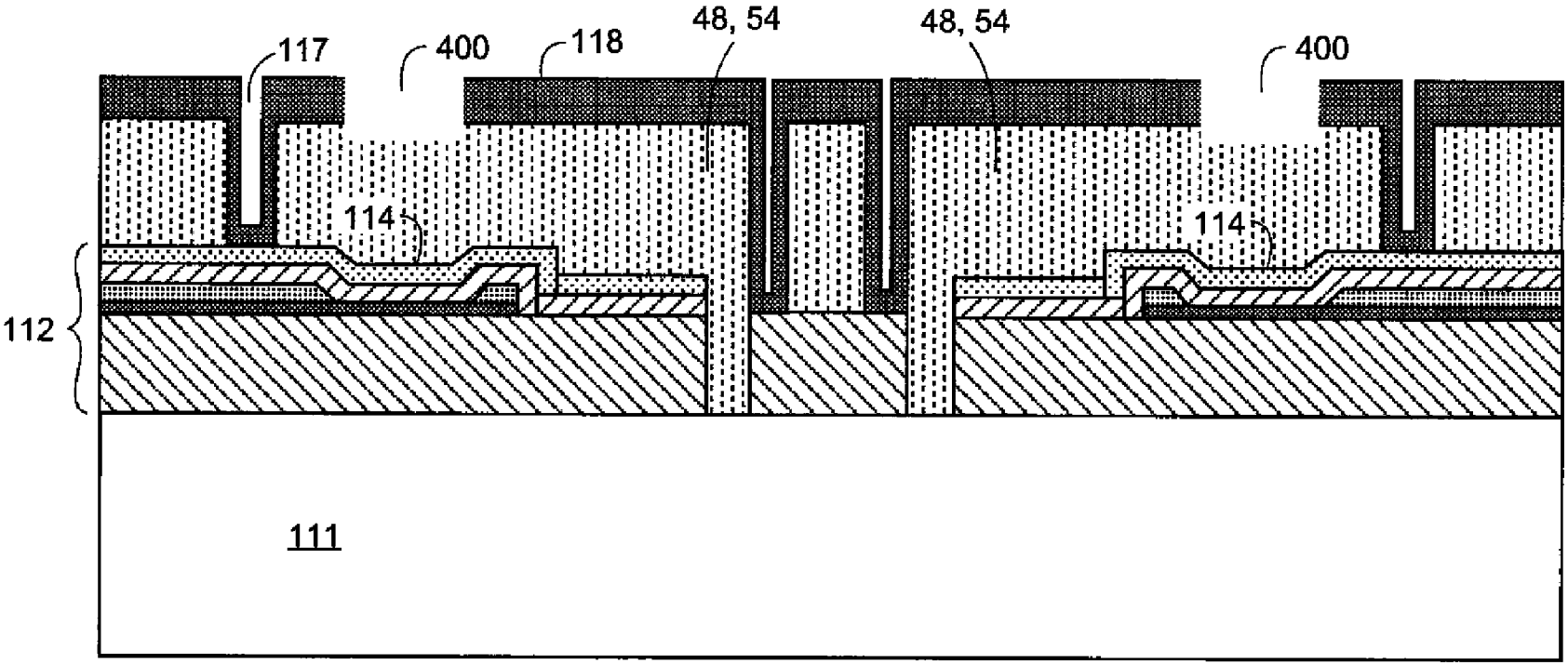

As shown in FIGS. 12F and 12G, multi-lobed nozzles 400 are formed in nozzle plate 118 in alignment with the corresponding heaters by using a mask 402 including multi-lobed regions 403. Mask 402 is aligned to the heater pattern and light 401 is transmitted through the transparent regions of mask 402 toward photoresist 406 that has been applied to the surface of the nozzle plate 118. (Multi-lobed regions 403 of mask 402 can be designed to be either transparent or opaque, depending upon the type of photoresist 406 that is used.) The photoresist 406 is thus exposed to form multi-lobed patterns 404, which are developed and cured. Then the nozzle plate 118 is etched through multi-lobed openings in the photopatterned photoresist 406, for example with a fluorine based plasma to form multi-lobed nozzles 400 in alignment with heaters 114 as shown in cross-section in FIG. 12G (after the photoresist 406 has been removed).

Figure 12H:
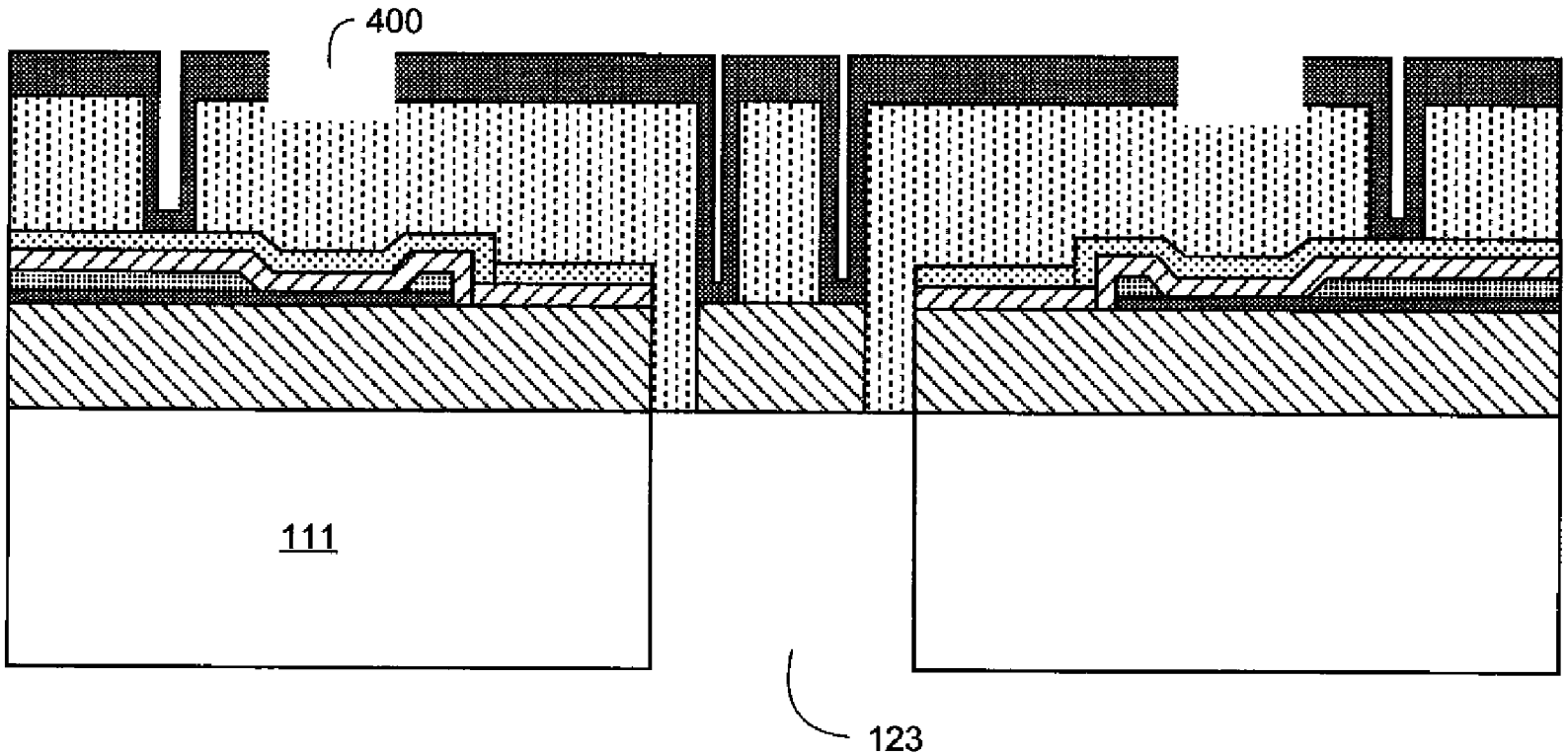
Figure 12I:
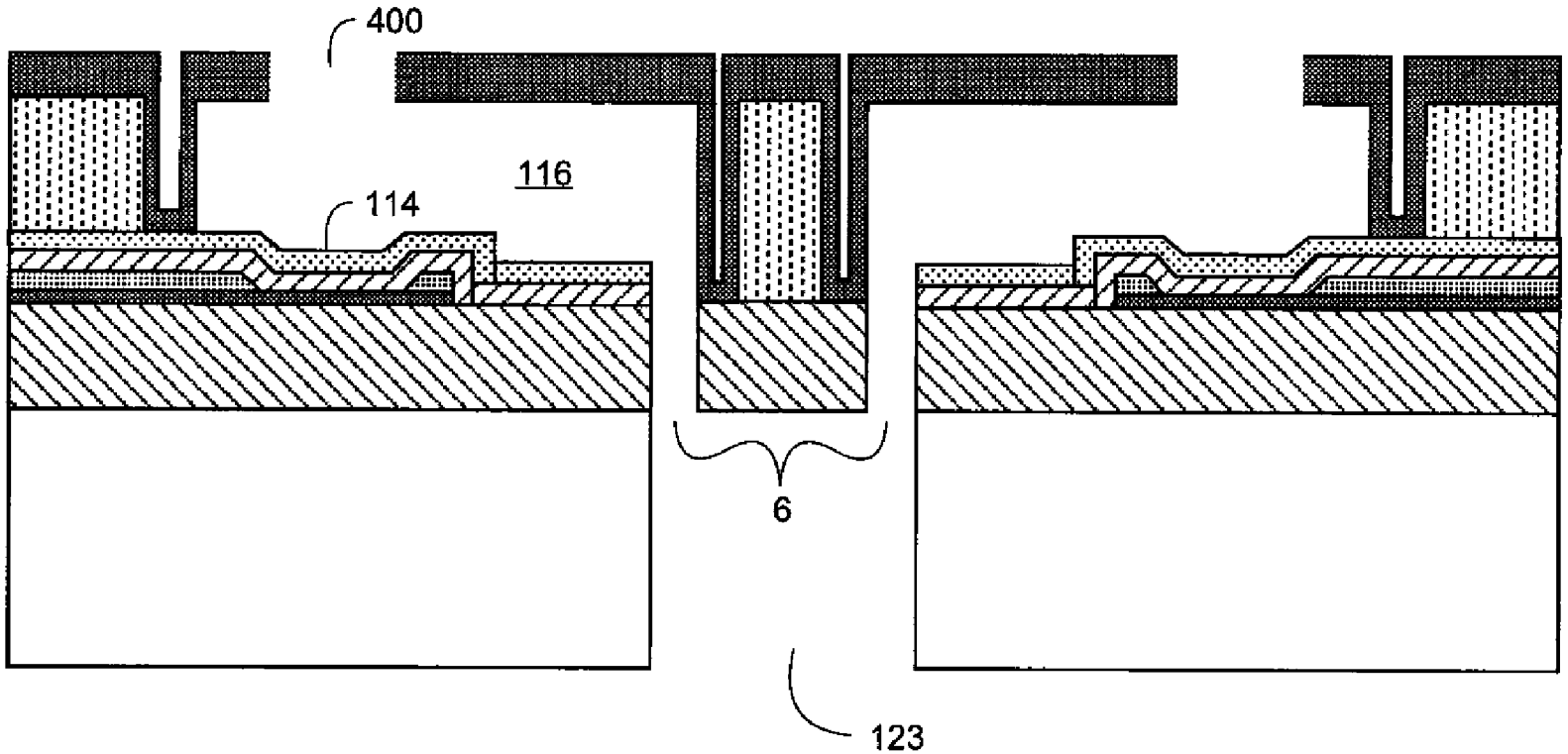

The feed opening 123 is then formed from the back of the substrate 111 by using deep reactive ion etching, as shown in FIG. 12H. At this point, organic material 48 is still disposed in sacrificial regions 54. As illustrated in FIG. 12I, an oxygen plasma is then used to etch out the organic material in sacrificial region 54 that defines ink chamber 116 and ink feed ports 6. By this method, a completed drop ejector is formed, having a silicon oxide nozzle plate 118 with multi-lobed nozzles 400 having been integrally formed as part of the wafer fabrication process and aligned to heaters 114.

Alternatively, multi-lobed nozzles can be formed using a fabrication process such as described in U.S. Pat. No. 4,789,425, incorporated by reference herein in its entirety. In that process, after the heater is formed on one side of the substrate, the ink delivery passageway is etched through the substrate from the opposite side using orientation dependent etching. A layer of photopatternable material such as photosensitive polyimide is applied and patterned to form chamber walls. Then a dry film photopatternable material is placed over the patterned chamber wall layer to serve as a nozzle plate. Multi-lobed nozzles 400 are formed in the dry film photopatternable material by using a mask including multi-lobed nozzle patterns. The mask is aligned relative to the heaters such that the multi-lobed nozzle patterns in the mask are aligned with the corresponding heaters. The dry film photopattemable material is exposed by transmitting light through the mask toward the dry film photopattemable material, which is then developed and cured to provide a nozzle plate having multi-lobed nozzles.

In other exemplary methods, the device including the heaters can be fabricated on a substrate, and a nozzle plate can be separately made having multi-lobed nozzles such that after the multi-lobed nozzles are formed in the nozzle plate, the nozzle plate is adhesively bonded to the substrate having the heaters. For example, the nozzle plate can be laser ablated to form multi-lobed nozzles according to the laser ablation process described in U.S. Pat. No. 5,305,018, incorporated by reference herein in its entirety. A strip of polymer film such as Teflon or polyimide is positioned under a laser (e.g. an Excimer laser) with a metal lithographic mask interposed between the laser and the polymer film. In this case, the metal lithographic mask is provided with multi-lobed transparent regions for the laser light to pass through. When the laser is turned on and directed toward the polymer film, it ablates the regions in the film corresponding to where the laser beam goes through the mask, thus forming multi-lobed nozzles in the film. The nozzle plate is subsequently affixed to the substrate having the heaters, such that the multi-lobed nozzles are aligned with the corresponding heaters. The ink chambers can be fabricated on the heater substrate prior to affixing the nozzle plate. Alternatively, the ink chamber structures can also be laser ablated as a separate piece (or as part of the nozzle plate) which is subsequently aligned and bonded to the device having the heaters.

The invention has been described in detail with particular reference to certain preferred embodiments thereof, but it will be understood that variations and modifications can be effected within the spirit and scope of the invention.

PARTS LIST

6 Ink feed ports
8 Center support region
10 Inkjet printer system
12 Image data source
14 Controller
15 Image processing unit
16 Electrical pulse source
18 First fluid source
19 Second fluid source
20 Recording medium
24 Thermal barrier layer
26 Electrically resistive layer
28 Electrically conductive layer
30 Insulating passivation layer
32 Protection layer
40 Passivation region
41 Center feed support
48 Organic material
51 Photoresist layer
52 Hard mask
54 Sacrificial layer
56 Center support region walls
100 Inkjet printhead
110 Inkjet printhead die
111 Substrate
112 Thin film layers
114 Heater
116 Chamber
117 Chamber wall
118 Nozzle plate
120 First nozzle array
121 Nozzle(s)
122 Ink delivery pathway (for first nozzle array)
123 Ink feed opening
130 Second nozzle array
131 Nozzle(s)
132 Ink delivery pathway (for second nozzle array)
133 Ink feed opening
134 Rib
142 Logic electronics
144 Driver transistors
146 Electrical leads
148 Interconnection pads
181 Droplet(s) (ejected from first nozzle array)
182 Droplet(s) (ejected from second nozzle array)
183 Drop head
184 Drop tail
185 Drop head
186 Drop tail
187 Extruded ink
200 Carriage
250 Printhead chassis
251 Printhead die
253 Nozzle array
254 Nozzle array direction
255 Mounting support member
256 Encapsulant
257 Flex circuit
258 Connector board

262 Multi-chamber ink supply
264 Single-chamber ink supply
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
313 Forward rotation direction (of feed roller)
330 Maintenance station
380 Carriage motor
382 Carriage guide rail
383 Encoder fence
384 Belt
390 Printer electronics board
392 Cable connectors
400 Multi-lobed nozzle
401 Light
402 Mask
403 Multi-lobed transparent regions
404 Multi-lobed patterns
406 Photoresist
410 Lobe
420 Centroid
422 Triangle centroid
430 Radial direction from centroid
440 Narrow portion
445 Most distal edge
450 Wide portion
460 Wide lobe
465 Narrow lobe

The invention claimed is:

1. A method of forming a multi-lobed nozzle, the method comprising the steps of:

providing a substrate;

providing a nozzle plate over the substrate;

forming a multi-lobed opening in the nozzle plate;

forming a heater on the substrate below the multi-lobed opening in the nozzle plate;

forming a fluid chamber between the multi-lobed opening in the nozzle plate and the heater; and wherein the step of forming a multi-lobed opening comprises:

providing a mask including a multi-lobed pattern;

transmitting light through the mask toward the nozzle plate; and performing an alignment to align the multi-lobed pattern with the heater.

2. The method of claim 1, further comprising the steps of forming a fluid supply channel in communication with the fluid chamber.

3. The method of claim 1 wherein the step of forming a multi-lobed opening further comprises the step of forming the opening with at least three lobes.

4. The method of claim 1, wherein the step of providing a nozzle plate further comprises forming a nozzle plate with an inorganic material.

5. The method of claim 4, wherein the step of forming a nozzle plate with an inorganic material further comprises depositing a silicon oxide material using plasma enhanced chemical vapor deposition.

6. The method of claim 1, wherein the step of providing a mask further comprises the step of depositing a photoresist on a surface of the nozzle plate, and wherein the step of transmitting light through the mask further comprises exposing the photoresist to form a multi-lobed pattern in the photoresist on the surface of the nozzle plate.

7. The method of claim 6, further comprising the step of etching the nozzle plate through the multi-lobed pattern in the photoresist on the surface of the nozzle plate.

8. The method of claim 7, wherein the step of etching the nozzle plate further comprises plasma etching the nozzle plate.

9. The method of claim 8, wherein the step of plasma etching further comprises using a fluorine based plasma.

10. The method of claim 1, wherein the step of performing an alignment further comprises aligning the mask relative to the heater.

11. The method of claim 1, wherein the step of forming a fluid chamber includes the step of forming a fluid chamber wall and wherein the step of providing a nozzle plate further comprises placing a dry film photopatternable material over the chamber wall.

12. The method of claim 11, wherein the step of transmitting light through the mask toward the nozzle plate further comprises transmitting light through the mask to expose the dry film, and wherein the method further comprises the steps of developing and curing the exposed dry film to form the multi-lobed opening in the nozzle plate.

13. The method of claim 1 wherein the step of transmitting light through the mask further comprises transmitting laser light through the mask.

14. The method of claim 13 wherein the laser light ablates a polymer film to form the multi-lobed opening.

15. The method of claim 14 wherein the laser light is provided by an Excimer laser.

16. The method of claim 14 wherein the polymer film having the multi-lobed opening is subsequently affixed to the substrate having the heater.

17. The method of claim 16, further comprising the step of aligning the polymer film having the multi-lobed nozzle to the substrate having the heater.

18. The method of claim 1, wherein the step of forming a multi-lobed opening comprises forming an opening having a plurality of lobes each extending from a central region of the opening, each of the lobes comprising a narrow portion and a wider portion wherein the wider portion is wider than the narrow portion and is further from the central region than the narrow portion.

* * * * *